United States Patent [19]

Alfano

[11] 4,003,471

[45] Jan. 18, 1977

[54] REVOLVING MESSAGE HOLDER

[76] Inventor: Elinor S. Alfano, 13833 Samoa Road, San Leandro, Calif. 94577

[22] Filed: Dec. 29, 1975

[21] Appl. No.: 644,973

[52] U.S. Cl. ..... 211/56; 211/129; 312/50

[51] Int. Cl.[2] ..... A47F 7/00

[58] Field of Search ..... 211/50–58, 211/126–133, 70, 79, 81, 96, 99, 174, 175, 49 R, 49 D; 221/190, 208, 209, 221, 223, 224, 226, 232, 238, 261, 268, 273, 274, 276, 279, 280, 311, 312; 232/1 E, 26, 45, 53; 312/183, 202, 107, 125, 252, 50, 60, 61; 206/77.1, 249, 255

[56] References Cited

UNITED STATES PATENTS

| | | | |
|---|---|---|---|
| 1,613,529 | 1/1927 | Payne | 312/252 |
| 1,807,611 | 6/1931 | Zapart | 232/45 |
| 2,333,717 | 11/1943 | Heed et al. | 312/50 |
| 2,399,533 | 4/1946 | Albright | 206/77.1 |
| 2,552,628 | 5/1951 | Gallaher | 232/53 X |
| 2,807,387 | 9/1957 | Siciliano | 312/107 X |
| 3,239,098 | 3/1966 | Wills | 221/261 X |
| 3,302,797 | 2/1967 | Kolster | 211/55 |
| 3,961,830 | 6/1976 | Gusswald | 312/107 X |

*Primary Examiner*—Ramon S. Britts
*Assistant Examiner*—Terrell P. Lewis

[57] ABSTRACT

An upstanding rack which is rotatable upon a stand, the rack consisting of several tiers one upon the other, each tier having several boxes all around its outer side, each box being adaptable to have message notes being inserted thereinto, so that wherever a large number of people are to be serviced, each of the persons is assigned one of the boxes so that he can readily see if there is any message for him.

1 Claim, 7 Drawing Figures

Fig. 1
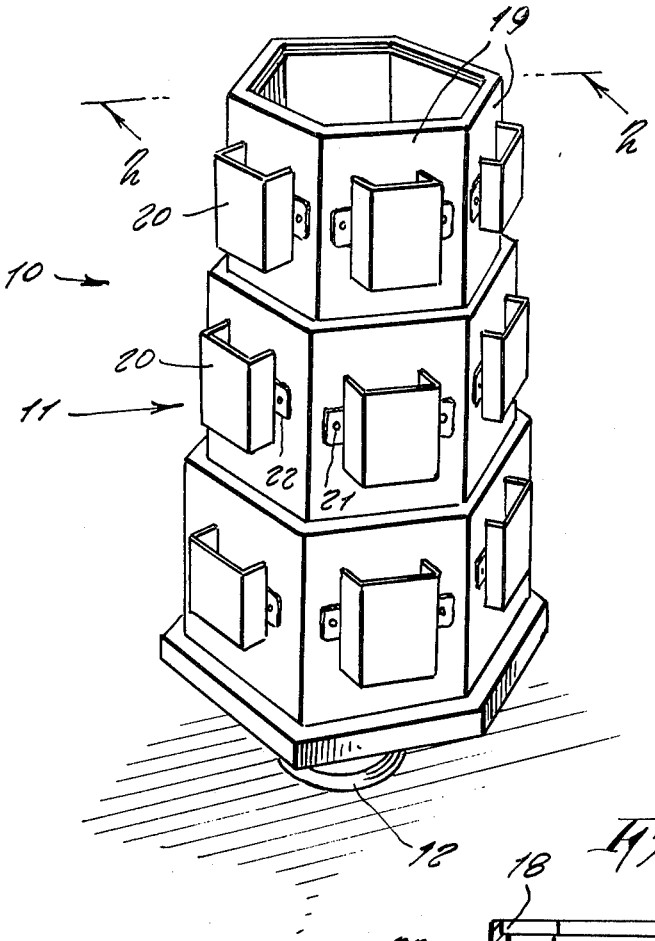
Fig. 3
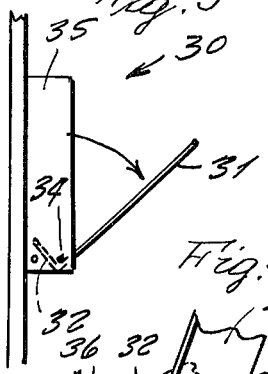
Fig. 3a
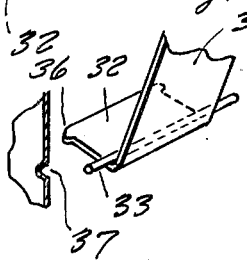
Fig. 2
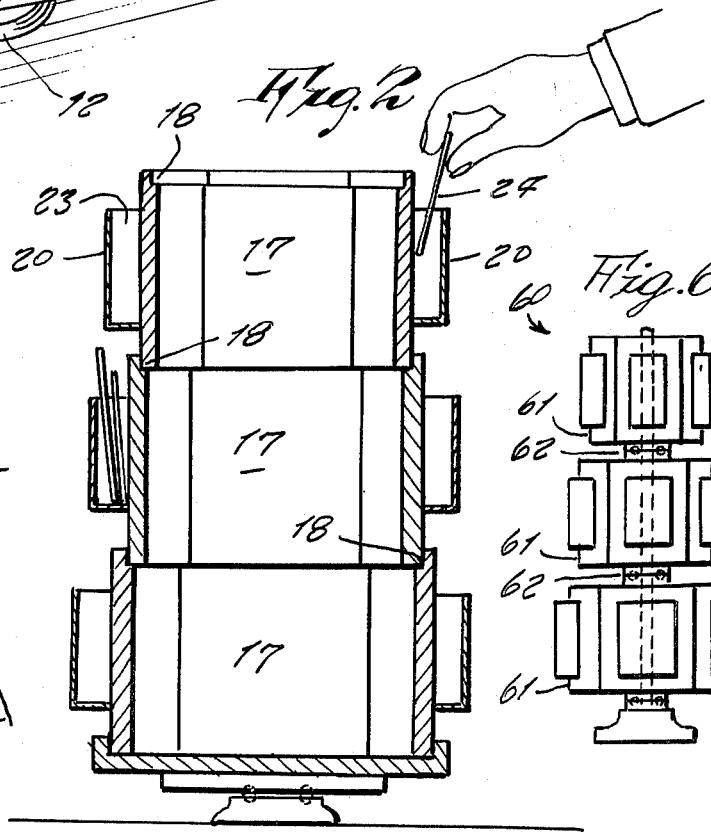
Fig. 6
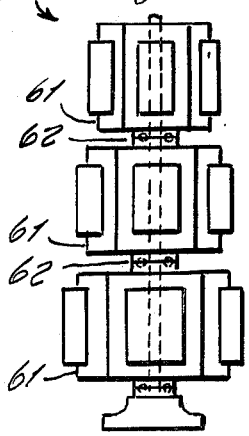
Fig. 4
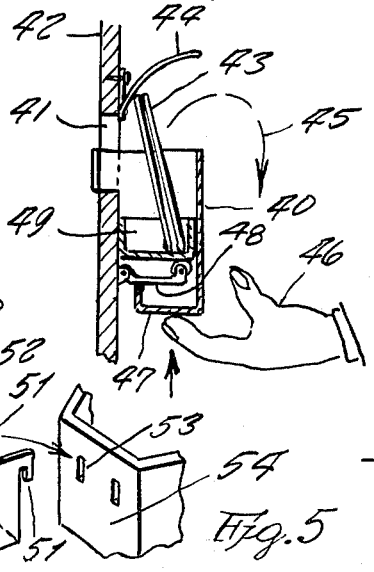
Fig. 5

REVOLVING MESSAGE HOLDER

This invention relates generally to message holders.

A principal object of the present invention is to provide a message holder having a large number of boxes each one of which is assigned for a particular individual, each of the boxes being adaptable to have a message note inserted thereinto, so that any of the persons can quickly and easily see if there is a message for him.

Another object of the present invention is to provide a message holder having message boxes located all around a rack that is rotatable upon a stand so that the rack can be quickly and easily rotated around in order that a particular box is thus brought in front of a person to see if there is a message left therein.

Still another object is of the present invention is to provide a revolving message holder which is adaptable particularly for a home having a large family, a business office with many employees, or a hotel serving many guests.

Still another object of the present invention is to provide a revolving message holder which is adaptable to also receive mail letters so that the same can be quickly and easily picked up by individuals themselves instead of being serviced.

Other objects are to provide a revolving message holder which is simple in design, inexpensive to manufacture, rugged in construction, easy to use and efficient in operation.

These and other objects will be readily evident upon a study of the following specification and accompanying drawing, wherein:

FIG. 1 is a perspective view of the present invention;

FIG. 2 is a cross sectional view thereof taken on line 2—2 of FIG. 1;

FIG. 3 is a side view of a message box showing an alternate design;

FIG. 3*a* is a fragmentary perspective view of structure shown in FIG. 3;

FIG. 4 is a cross sectional view of yet another alternate design of box;

FIG. 5 is a fragmentary perspective view showing an alternate message attachment of the box to a rack;

FIG. 6 is a side elevation view of a further modified design of the invention in which different tiers of the rack are individually rotatable.

Referring now to the drawing in greater detail, and more particularly to FIGS. 1 and 2 thereof at this time, the reference numeral 10 represents a revolving message holder according to the present invention wherein there is a rack 11 that is supported rotatably upon a stand 12 which stands stationary upon any supporting surface 13, as for example a desk or table. The stand 12 includes a base 14 provided with a thrust bearing 15 therebetween and a platform 16 of the rotatable rack 11. Upon the platform 16 there are stacked several tiers of hexagonal or other shaped frames 17, each one of which is progressively smaller in size upwardly so that they may be fitted one upon the other as shown particularly in FIG. 2. Thus a groove 18 upon an upper end of each frame serves to nest a lower end of a frame located thereabove. Upon each outer side 19 of each frame 17 there is mounted a box 20 made of any suitable rigid material such as metal or the like and which is secured thereto by means of screws 21 fitted through tabs 22. The box has an opening 23 at its upper end so that message notes 24 may be literally dropped thereinto and where they may be retained until being picked up by an individual to whom the particular box is assigned.

It is now apparent that the rack may be made as high as necessary in order to accommodate as many boxes as are necessary. A person picking up a message note, needs only to rotate the rack until his own box is accessible to him so that he can reach thereinto. A person's name may be affixed to the outer side of the box for easy identification.

In FIGS. 3 and 3*a*, a modified design of box 30 is shown to include a front wall 31 integral with a bottom wall 32 at right angle thereto, and which are pivotable about a transverse rod 33 supported at its opposite ends with openings 34 in opposite side walls 35 of the box. A protrusion 36 on each opposite side edge of the bottom wall 32 is adaptable for snapping into a dimple 37 formed on each side wall so to retain the box in a closed position. When the box is wished to be opened for removal of a message, the upper end of the front wall is simply grasped and pivoted downwardly as indicated by arrow 38 for easy access into the box.

In FIG. 4 another modified design of box 40 is vertically slideable within a slot 41 of a frame panel 42. When the box is thus upwardly pushed, a message note 43 contained within the box thus bears against an underside of an outwardly curved plate 44, so that the message notes drop outwardly of the box as indicated by arrow 45 and into a persons' hand 46. In order that only a short upwardly movement of the box is necessary and the upward motion of the message note is increased in speed, an underside 47 of the box bears against a lever 48 and near its pivot end so that an opposite end of the lever thus quickly thrusts upwardly a tray 49 contained within the interior of the box, and in which the note is upwardly carried.

Thus several different forms of the invention have been presented.

While various changes may be made in the detail construction, it is understood that such changes will be within the spirit and scope of the present invention as defined by the appended claim:

What I now claim is:

1. In a revolving message holder, a combination of a stationary stand, and a rotatable rack, supported upon said stand, said stand including a base having a thrust bearing upon which as platform is rotatably carried, said platform carrying said rack, said rack being comprised of a plurality of frames stacked one upon another, each of said frames having a plurality of panels arranged in a circle, an outer side of each said panel having a message box attached thereto, each said message box being open at its upper end for placement of messages thereinto, said box being vertically slideable within a slot of said frame panel, an upwardly, forwardly, arcuate plate secured upon a front side of said frame panel, a vertically slideable tray within said box, said tray resting upon one end of a lever, which at its other end is pivotable about a bearing secured to the front side of said frame panel, and the underside of said box bearing against the underside of said lever in the vicinity of said pivot.

* * * * *